United States Patent [19]

Chung

[11] Patent Number: 4,942,072

[45] Date of Patent: Jul. 17, 1990

[54] CARPET TILES WITH EDGES PROJECTIONS AND GROOVES

[76] Inventor: Farn-Juoh Chung, No. 1, Miao-Pu Lane, Hsiao-Shin Li, Shan-Hua Town, Tainan Hsien, Taiwan

[21] Appl. No.: 350,603

[22] Filed: May 11, 1989

[51] Int. Cl.[5] ..... B32B 3/10

[52] U.S. Cl. ..... 428/48; 428/51; 428/82; 428/88

[58] Field of Search ..... 428/44, 48, 51, 60, 428/62, 82, 88, 40

[56] References Cited

U.S. PATENT DOCUMENTS 3,120,083 2/1964 Dahlberg et al. ..... 428/82

3,654,051 4/1972 Bieler ..... 428/88

*Primary Examiner*—Marion C. McCamish

*Attorney, Agent, or Firm*—Limbach, Limbach & Sutton

[57] ABSTRACT

A carpet includes at least two sets of square carpet tiles of different sizes. The carpet tiles of the carpet have a plurality of trapezoidal projections and complementary grooves so that the tiles may be interlocked with each other. One set of the carpet tiles has edges which are longer than those of the other set each of which is integrally proportional to an edge of the other set of carpet tiles. A special trapezoidal tooth and a complementary notch adjacent the tooth are provided at each longer edge of the carpet tiles and equally spaced from each other by one unit length, the unit length equalling the length of the edge of a tile from the other set of carpet tiles.

1 Claim, 6 Drawing Sheets

CARPET TILES WITH EDGES PROJECTIONS AND GROOVES

BACKGROUND OF THE INVENTION

This invention relates to a carpet, and more particularly to a carpet which has sets of carpet tiles of different sizes which may be installed in an interlocking relationship with a series of adjacent tiles.

The currently available carpet tiles are in the form of squares having edges with projections and grooves. The projections and grooves complement each other so that the projections on one tile can be received in the grooves of an abutting tile to form an interlocking connection therebetween. In this way, the tiles can be installed in an abutting relationship so as to form a one-piece carpet. Each tile of uniform size is formed with a light platic plate having nonwoven fabrics adhered thereonto. Each tile has patterns provided on the nonwoven fabrics to enhance the esthetic quality of said carpet by means of changing the arrangement of said tiles. Referring to FIG. 1, a conventional tile unit 10 of a carpet is shown. The tile 10, which is generally square in outline, has a plurality of exposed trapezoidal projections 11 extending along the edges thereof, and a plurality of complementary grooves 12 formed between said projections 11 which interlock with the projections of adjacent tiles, as shown in FIG. 2. Four specific protrusions 13 are perspectively extended from the corners of the tile 10. Referring to FIGS. 3 and 4, each of the specific protrusions 13 is in the shape of a pentagon. Said pentagon is a combination of a trapezoid 131 and a isosceles right triangle 132. The hypotenuse 1321 of the right triangle 132 overlaps with a vertical side of the trapezoid 131 having an altitude H. The trapezoid 131 further has an inclined side 1311 opposite to the vertical side thereof which is adjacent one of the complementary grooves 12. The length L' of one parallel side 1312 of the trapezoid 131, which is remote from the edge of the tile 10, equals to that of the parallel side 111 of the projection 11 which is adjacent to the edge of said tile 10. The length of the other parallel side 1313 of the trapezoid 131, which is adjacent the edge of the tile 10, equals the difference between the length L of another parallel side 112 of the specific projection 13 and the altitude H of the specific projection 13, (i.e. L-H). As illustrated in FIG. 3, one side 1311 of the specific projection 13 is adjacent to one of said complementary grooves 12 and the opposite side thereof 1322 is adjacent to a specific groove 14. The specific projection 13 is spaced from the specific groove 14 at a distance L' along the edge of the tile 10. However, conventional carpet tiles of an uniform size cannot be used with carpet tiles of another make and uniform size, thus limiting the variety of the design which may be created with the carpet which is formed by means of the interlocking of said carpet tiles.

SUMMARY OF THE INVENTION

It is therefore a main object of this invention to provide carpet tiles of different sizes which may be interlocked to form a carpet the design of which may be changed as desired, depending upon the placement of said tiles.

Accordingly, the carpet comprises a first set of carpet tiles and a second set of carpet tiles of different sizes. The first and second sets of carpet tiles, which are generally in the form of squares, have a plurality of exposed projections and grooves of the same size formed along the edges thereof, wherein the length of the edge of the second carpet tile is integrally proportional to the length of the edge of the first carpet tile, which is equal to one unit length. Said projections and grooves have the same shape, and are arranged along the edges of the carpet tiles in a manner similar to that of the projections and grooves of the abovementioned conventional carpet tiles. Each edge of said second carpet tile has a plurality of trapezoidal teeth each having a notch adjacent thereto. Said trapezoid teeth are spaced from one another as well as the corners of said second carpet tile at a distance equal to said one unit length. Each of said trapezoidal teeth have an altitude equal to that of the first projection of the first carpet tile; a first parallel side adjacent to the edge of the second carpet tile which has a length equal to that of the parallel side of the second projection remote from the edge of the second carpet tile; a second parallel side opposite said first parallel side of said tooth which has a length equal to that of the first parallel side of the second projection adjacent the edge of the second carpet tile; a third side adjacent one of the second grooves of the second carpet tile; and a fourth side having a length which is longer than that of said third side of the tooth and adjacent said notch of said second carpet tile. Each of said notches is in a shape complemental to that of said tooth so as to interfit with a corresponding projection of an adjacent carpet tile. In this way, the carpet can be assembled to form a variety of patterns.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF A PREFERRED EMBODIMENT

Figure 1:
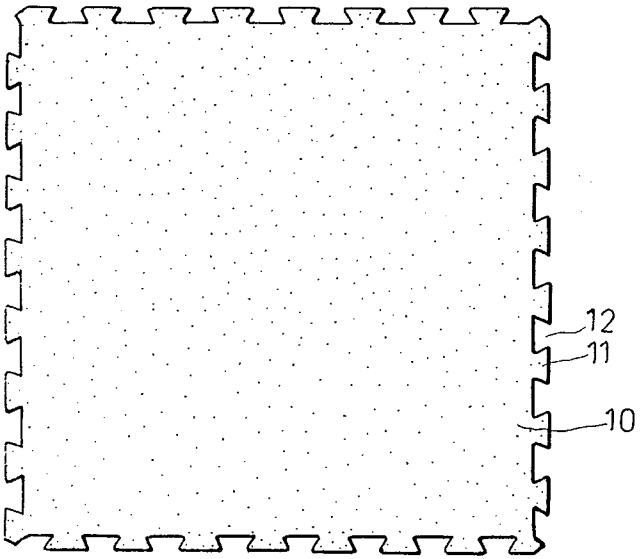
FIG. 1 PRIOR ART
FIG. 1 is plan view of a convetional carpet tile of a carpet.
Figure 2:
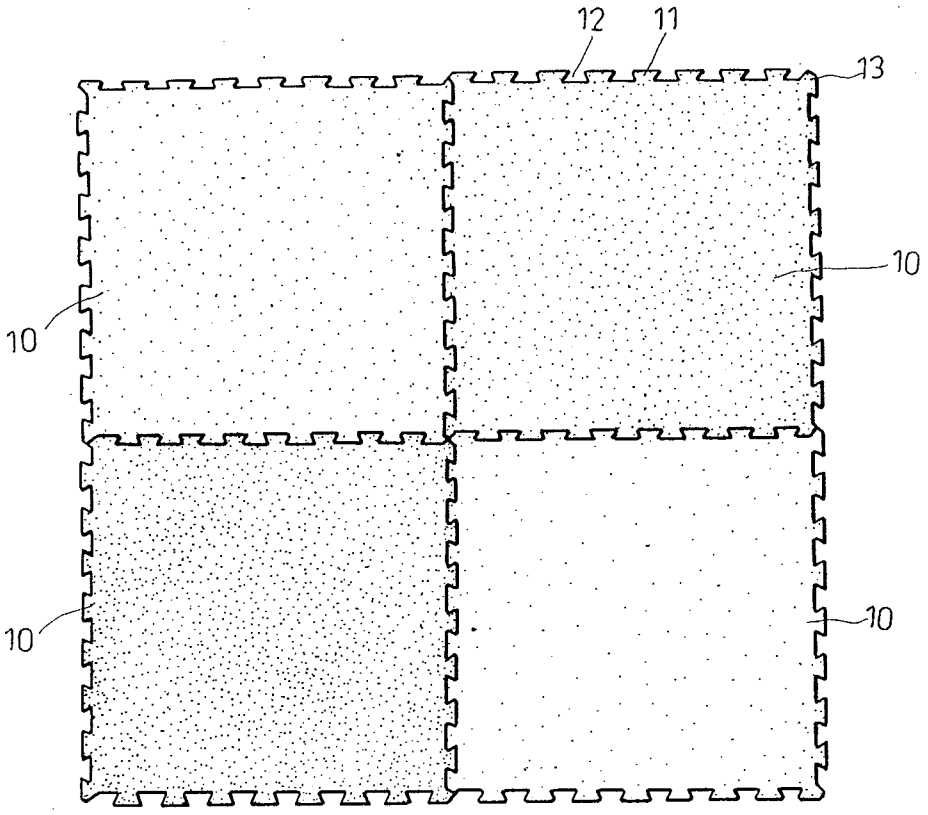
FIG.2 PRIOR ART
FIG. 2 is a schematic plan view showing the conventional carpet tiles in an interlocking position.
Figure 4:
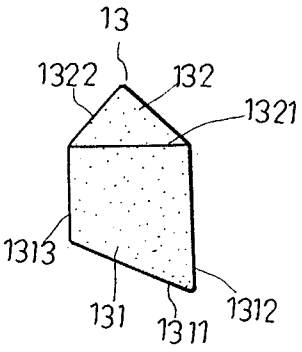
FIG. 4 PRIOR ART
FIG. 4 is a schematic view showing the configuration of the specific projection of FIG. 3.
Figure 3:
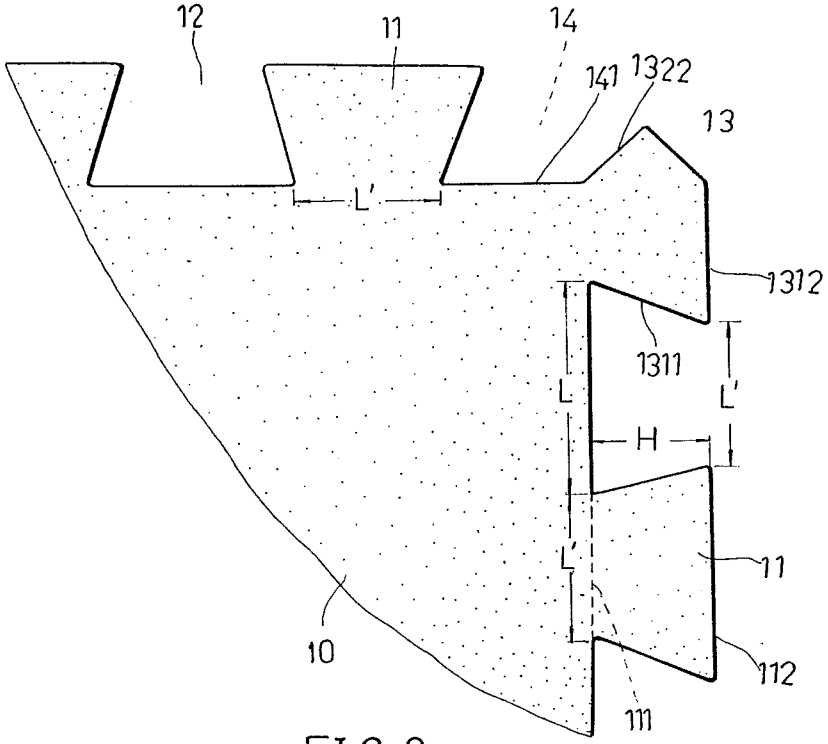
FIG 3 PRIOR ART
FIG. 3 is a schematic view showing a specific projection extending from a conventioal carpet tile.
Figure 8:
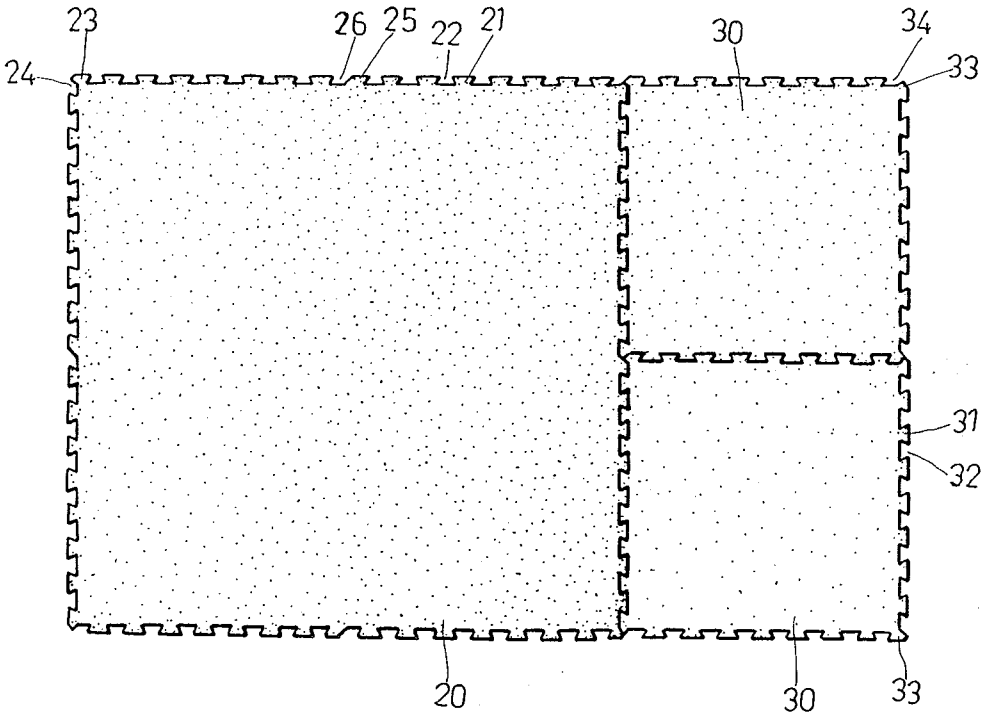
FIG. 8 is a schematic view showing a large carpet tile interlocking with two small carpet tiles.

In accordance with the present invention, a carpet includes at least two sets of carpet tiles of different sizes. In this embodiment, the carpet tiles of this invention consist of a plurality of small carpet tiles 30 and a plurality of large carpet tiles 20. Each of the small carpet tiles 30 which has the configuration similar to the conventional carpet tile 10 illustrated in FIG. 1 hereinbefore. The small tiles 30 are square in outline and each of which is provided with projections 31, complementary grooves 32, specific projections 33 and specific grooves 34, similar to those of said conventional carpet tile 10, so as to interlock with the adjacent carpet tiles in a manner similar to that of said conventional carpet tiles 10, as illustrated in FIG. 8. Each edge of the small carpet tile 30 has a length which is defined as one unit length.

Figure 5:
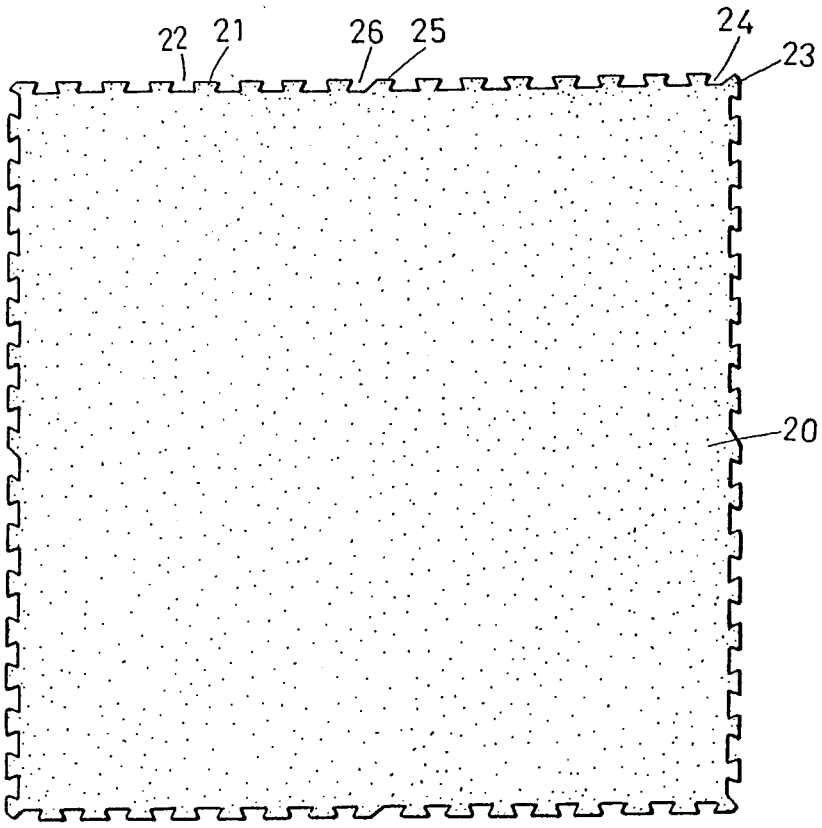
FIG. 5 is a plan view of a preferred embodiment of a large carpet tile of this invention.
Figure 6:
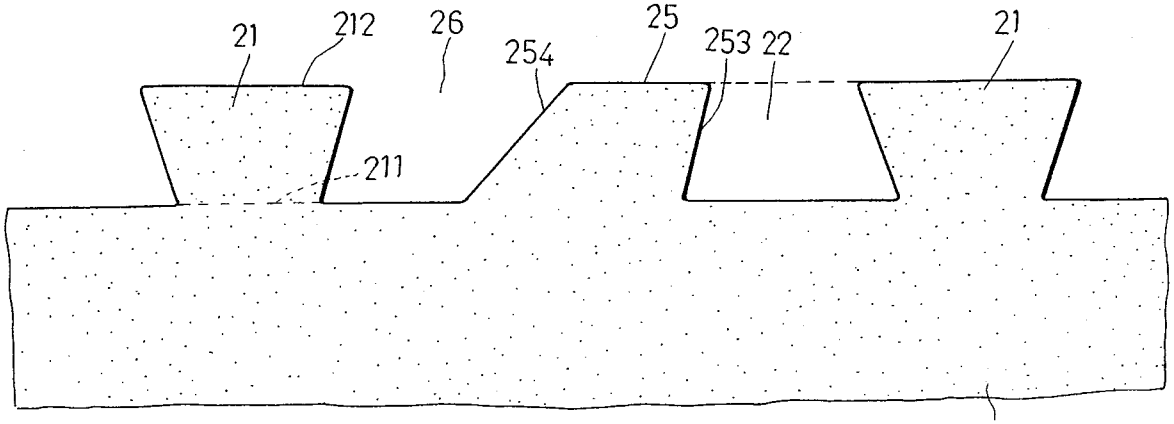
FIG. 6 is a fragmentary view showing part of the protrusions and the grooves provided along the edge of said large carpet tile according to this invention.
Figure 7:
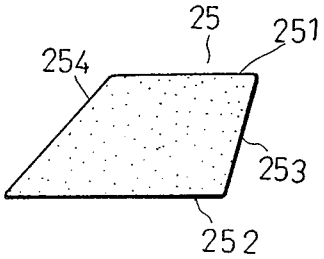
FIG. 7 is a fragmentary view showing a projecting tooth of said large carpet tile of FIG. 6.

Referring to FIG. 5, a plan view of a preferred embodiment of a large carpet tile 20 of this invention is shown. The large carpet tile 20 is square in outline and each edge of the large carpet tile 20 has a length equal to two unit lengths, i.e., twice the length of the edge of the small carpet tile 30. A plurality of trapezoidal projections 21 and grooves 22 are provided along the edges of the large carpet tile 20 and four specific projections 23 and specific grooves 24 are respectively provided at the corners of the large carpet tile 20 in a manner similar to those of the small carpet tile 30. The projections 21, 23 and the grooves 22, 24 are of the same shape and size as those of the small carpet tile 30 so that the large carpet tiles 20 and the small carpet tiles 30 can interlock with each other. Each of the large carpet tiles 20 has an exposed trapezoidal tooth 25 and a notch 26 adjacent the tooth 25 extending from the middle portion of each edge thereof, i.e. at a position one unit length from the corner of the large carpet tile 20. The notch 26 has a configuration complemental to that of the tooth 25. Referring to FIGS. 6, 7, the upper parallel side 251 of the tooth 25, remote from the edge of the carpet tile 20, is of a length equal to that of the lower parallel side 211 of the projection 21, adjacent the edge of the carpet tile 20. The lower parallel side 252 of the tooth, adjacent the edge of the carpet tile 20, is of a length equal to that of the upper parallel side 212 of the projection 21, remote from the edge of the carpet tile 20. The right side 253 of the tooth 25 adjacent said groove 22, is shorter than the left side 254 of said tooth 25. In fact, a combined configuration of the teeth 25 and the adjacent notch 26 is the same as that of the projection 21 and the adjacent groove 22.

Figure 9:
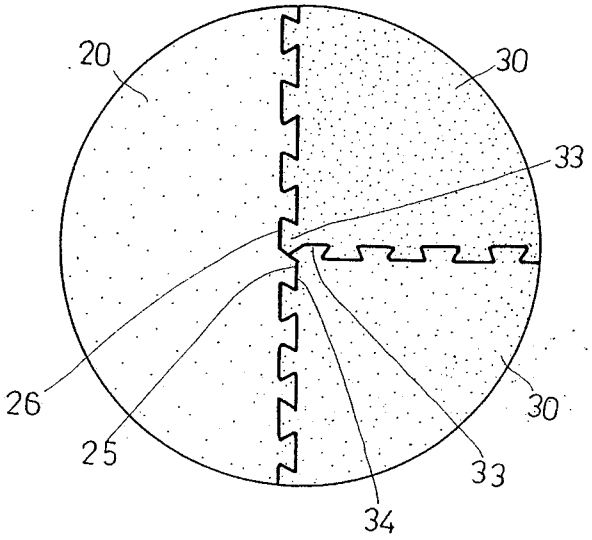
FIG. 9 is an enlarged schematic plan view showing the interlocking of the large and small carpet tiles illustrated in FIG. 8.

Referring to FIG. 8, two interlocked small carpet tiles 30 are connected to a large carpet tile 20 with the projections 21, 23, 31 and the grooves 22, 24, 32 interlocking with each other therebetween. The tooth 25 of the large carpet tile 20 is fit into a specific groove 34 of the lower small carpet tile 30. The notch 26 of the large carpet tile 20 receives the specific projection 33 of the upper small carpet tile 30 and a part of the specific projection of the lower small carpet tile 30, as best illuatrated in FIG. 9. It is understood that the large carpet tiles 20 can also be interlocked with each other. In this respect, the carpet of this invention can be assembled in a variety of patterns. In addition, each edge of the large carpet tile can also equal three unit lengths so that said large carpet tile can interlock with three small carpet tiles to cover a larger floor surface and allowing the creation of more patterns.

With this invention thus explained, it is apparent that numerous modifications and variations can be made without departing from the scope and spirit thereof. It is therefore intended that this invention be limited only a indicated in the appended claims.

I claim:

1. A carpet comprising:

a first set of carpet tiles and a second set of carpet tiles, said first and second sets of carpet tiles being of different sizes and being adapted to interlock with one another;

each of said first carpet tiles being in the form of square with four edges, each edge equalling one unit length, and a first plurality of exposed projections which are equally spaced apart therealong, each of said first projections being in the shape of an isosceles trapezoid with a first parallel side adjacent to said edge of said first carpet tile and a second parallel side having a length which is longer than that of said first parallel side, each side of said first carpet tile further having a first plurality of equally spaced complementary grooves arranged between said first projections so as to interlock with corresponding projections of an adjacent carpet tile;

each of said first carpet tiles having four first protrusions respectively extending from four corners thereof, each first protrusion being of a configuration which is a combination of an trapezoid and an isosceles right triangle with a hypotenuse that overlaps a vertical side of said trapezoid;

said trapezoid having an altitude equal to that of each said isosceles trapezoidal projection; an inclined side which is opposite to said vertical side, adjacent to one of said first grooves of said first carpet tile; a first parallel side, remote from said edge of said first carpet tile, having a length equal to that of said first parallel side of said first projection; and a second parallel side opposite to said first parallel side of said trapezoid which has a length equal to the difference of the length between said second parallel side of said first projection and the length of said altitude of said first projection; one of said first projections being spaced from a side of said isosceles right triangle at a distance equal to the length of said first parallel side of said trapezoid along the edge of said first tile;

each of said second carpet tiles, which are in the form of a rectangle with four edges, each edge of which has a length integrally proportional to that of said first carpet tile; a second plurality of projections and complementary grooves having the same size, configuration and arrangement as those of said first projections and complementary grooves of said first carpet tiles; four second protrusions respectively extending from four corners thereof which have the same size and configuration as those of first protrusions of said first carpet tiles; wherein the improvements lie in the fact that each edge of said second carpet tile has a plurality of trapezoidal teeth each having a notch adjacent thereto, said trapezoidal teeth being spaced apart from one another and said corners of said second carpet tile at a distance equal to said unit length, each of said trapezoidal teeth having an altitude equal to that of said first projection of said first carpet tile; a first parallel side adjacent said edge of said second carpet tile which has a length equal to that of said second parallel side of said second projection; a second parallel side opposite to said first parallel side of said tooth which has a length equal to that of said first parallel side of said second projection; a third side adjacent said second complementary groove of said second carpet tile; and a fourth side which is adjacent said notch of said second carpet tile having a length which is greater than that of said third side of said tooth; each of said notches being in a shape which accommodates that of said tooth so as to interlock with a corresponding projection of a adjacent carpet tile.

* * * * *